US009165480B2

(12) United States Patent
Panunto

(10) Patent No.: US 9,165,480 B2
(45) Date of Patent: Oct. 20, 2015

(54) SHIPPING DOCUMENT AND METHOD AND APPARATUS FOR APPLYING A SHIPPING DOCUMENT TO A SURFACE

(71) Applicant: PSI Engineering, Mississauga (CA)

(72) Inventor: John Panunto, Mississauga (CA)

(73) Assignee: PSI Engineering, Mississauga, CA (US)

( * ) Notice: Subject to any disclaimer, the term of this patent is extended or adjusted under 35 U.S.C. 154(b) by 157 days.

(21) Appl. No.: 13/685,376

(22) Filed: Nov. 26, 2012

(65) Prior Publication Data

US 2014/0147612 A1 May 29, 2014

(51) Int. Cl.
*G09F 3/00* (2006.01)
*G09F 3/10* (2006.01)

(52) U.S. Cl.
CPC ..... *G09F 3/0288* (2013.01); *G09F 3/10* (2013.01); *Y10T 156/1051* (2015.01); *Y10T 428/15* (2015.01)

(58) Field of Classification Search
CPC G06F 2003/022; G06F 3/0288; G06F 3/0289
USPC ..... 283/81, 60.1, 66.1
See application file for complete search history.

(56) References Cited

U.S. PATENT DOCUMENTS

| | | | | |
|---|---|---|---|---|
| 4,711,686 | A * | 12/1987 | Instance | 283/81 |
| 5,776,571 | A * | 7/1998 | Michlin et al. | 428/40.1 |
| 2002/0113428 | A1* | 8/2002 | Phillips et al. | 283/62 |
| 2013/0249205 | A1* | 9/2013 | Bellmyer et al. | 283/81 |
| 2014/0138277 | A1* | 5/2014 | Raming | 428/43 |

* cited by examiner

*Primary Examiner* — Kyle Grabowski
(74) *Attorney, Agent, or Firm* — Walker & Jocke

(57) ABSTRACT

A shipping document comprises a first printable portion and a second printable portion attached together by a connecting strip comprising at least one detachable chad, and at least one detachable border strip removably attached to at least one free edge of the first printable portion. When the second printable portion is folded against the first printable portion the border strip extends beyond the second printable portion. When an adhesive is applied to the removable chad and the border strip, the shipping label can be secured to a surface by the adhesive and subsequently removed from the surface by detaching the border strip and the chad from the sheet, while the first and second printable portions remain attached along the connecting strip. The invention includes a method and apparatus for applying the shipping document to a surface.

24 Claims, 12 Drawing Sheets

10

10

SHIPPING DOCUMENT AND METHOD AND APPARATUS FOR APPLYING A SHIPPING DOCUMENT TO A SURFACE

FIELD OF THE INVENTION

This invention relates to shipping documents and a method and apparatus for applying shipping documents to containers.

BACKGROUND OF THE INVENTION

Shipping documents are widely used by distribution warehouses, organizations and carriers to accompany delivery packages. Shipping documents typically include shipping labels and packing slips or shipping lists. Shipping labels are generally identification labels affixed to the shipping container to provide originating and destination information, as well as other non-confidential and useful information required by transport or carrier companies, customs and other government authorities, customers, etc. Packing slips and shipping lists provide information about the contents of the shipping container, often including information regarding the content, courier, warranty, control marks, operation, invoices, messages, drawings, destination address, optical tracing information, transponder, reference number and/or other pertinent information.

Current methods of creating and affixing shipping documents (such as shipping labels and packing slips) to a shipping container (such as a carton, envelope, container or other item) generally employ an adhesive envelope or pouch as a means of carrying the shipping documents. For example, the packing slip is often sealed in a clear plastic pouch and affixed to the exterior of the shipping container. Adhesives are used to affix the pouch to the shipping container, typically pre-applied pressure sensitive adhesives that are covered by a removable protecting strip or "release layer", such that when the release layer is removed the pouch can be adhered to the shipping container by the application of pressure along the adhesive-bearing portion of the pouch.

The packing slip is typically folded in a manner which hides confidential information or other information that is not necessary to the shipping of the container, for example the contents of the container, and inserted in the pouch, through a slit formed in the pouch that can be sealed either independently or as the pouch is adhered to the container. Upon receiving the container the recipient accesses the interior of the pouch and its contents by removing a tear strip or the like from the face of the pouch. While the shipping documents are sealed in the pouch, only information necessary for the shipping of the container is visible, such as the shipping label.

Distribution warehouses, organizations and carriers who fill orders for goods may employ manual processes, or partially or fully automated processes, to create and affix shipping documents to a shipping container, using for example the conventional shipping pouch described above. However, a shipping document constituted by a single sheet of printable material which includes both the shipping label and the packing slip is desirable, as it reduces the amount of paper used and facilitates creation because the shipping documents can be printed by a single pass through a conventional printer. However, automated systems currently employed to create and affix such shipping documents are very slow, averaging a rate of about 15 shipping containers per minute. With growing e-commerce activity, the demands are higher than ever and industry requires significantly higher rates in order to prevent bottlenecks and meet delivery timelines.

Another option is to employ a thermal print technology to print the packing list on the rear face of the shipping label, which is then applied to the shipping container. This option is also slow, and creates a further problem for the end user recipient because the shipping label is typically a small piece of paper, which makes the packing list difficult both to read and to file. As most businesses are accustomed to using letter size paper or legal size paper, the recipient of smaller packing lists will often take the additional step of photocopying the small packing list in order to record it on a larger sheet of paper for filing, which is time consuming and uses additional paper.

BRIEF DESCRIPTION OF THE DRAWINGS

In drawings which illustrate by way of example only a preferred embodiment of the invention.

DETAILED DESCRIPTION OF THE INVENTION

The present invention reduces the time associated with creating and affixing a shipping label, packing slip and/or other documents to a shipping container. It allows for the creation of a packing slip with a shipping label at the same time and in the same apparatus. The packing slip according to the invention is simple to use and inexpensive to manufacture, and can be made in various sizes. In some embodiments the shipping documents can be printed on both sides of the sheet, thus lowering paper consumption.

The invention provides a shipping document comprising: a printable sheet having a front face for containing printed matter and a rear face, comprising a first printable portion and a second printable portion attached together by a connecting strip comprising at least one detachable chad, the connecting strip extending at least partially along a connecting edge of the first printable portion, and at least one detachable border strip removably attached to at least one free edge of the first printable portion, such that when the second printable portion is folded against the rear face of the first printable portion the border strip extends beyond the second printable portion, whereby when an adhesive is applied to the front face of the removable chad and the border strip, the shipping document can be secured to a surface by the adhesive with the second printable portion and the border strip folded against the first printable portion, and subsequently removed from the surface by detaching the border strip and the chad from the sheet while the first and second printable portions remain attached by the connecting strip.

The invention further provides a method of applying a shipping document to a surface, the shipping document having a front face for containing printed matter and a rear face and comprising a first printable portion attached to a second printable portion by a connecting strip comprising at least one detachable chad, the connecting strip extending at least partially along a connecting edge of the first printable portion, and at least one detachable border strip removably attached to at least one free edge of the first printable portion such that when the second printable portion is folded against the first printable portion the border strip extends beyond the second printable portion, comprising the steps of: a. folding the second printable portion against the rear face of the first printable portion, and b. adhering the chad and the border strip to the surface, whereby the shipping document can be removed from the surface by detaching the border strip and the chad from the sheet, while the first and second printable portions remain attached along the connecting strip.

Figure 1:
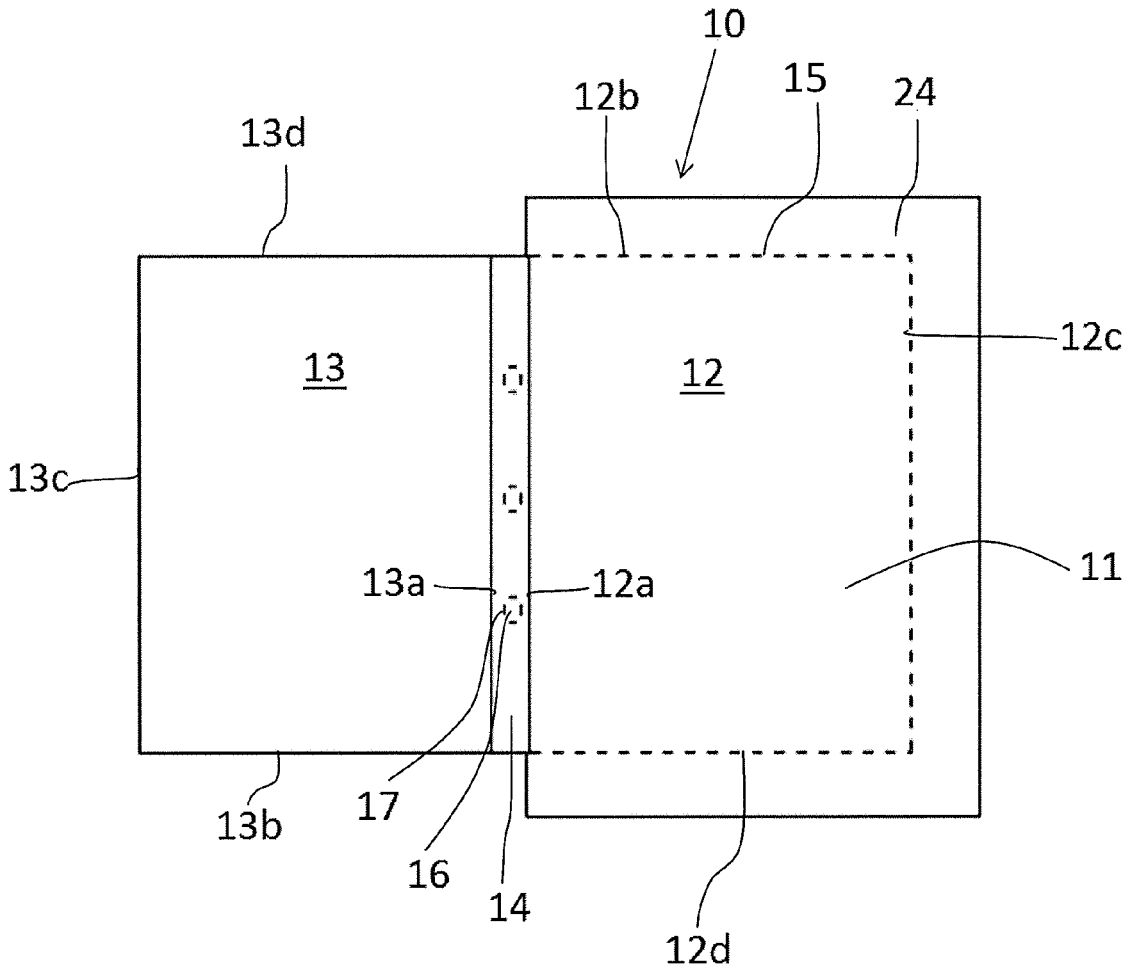
FIG. 1 is a front plan view of a blank for a shipping document according to the invention.

FIG. 1 illustrates a blank of a first embodiment of a shipping document 10 according to the present invention. The shipping document 10 includes a front face 11 and a rear face (not shown). In this embodiment at least the front face 11 comprises a printable surface, for example paper, suitable for the printing if information and other indicia. It will be appreciated that only those portions of the shipping document which carry information or indicia need to have printable surfaces, however in the preferred embodiment the shipping document 10 is created from a standard sheet of paper of the desired size, which is inexpensive and widely available.

At least the front surface 11 is printable in the embodiment shown in FIG. 1. The shipping document 10 comprises a first printable portion 12 and a second printable portion 13. Advantageously the first and second printable portions 12, 13 are part of a single sheet of printable material, such that the first and second printable portions 12, 13 can be printed by a single pass through a conventional printer.

Figure 2A:
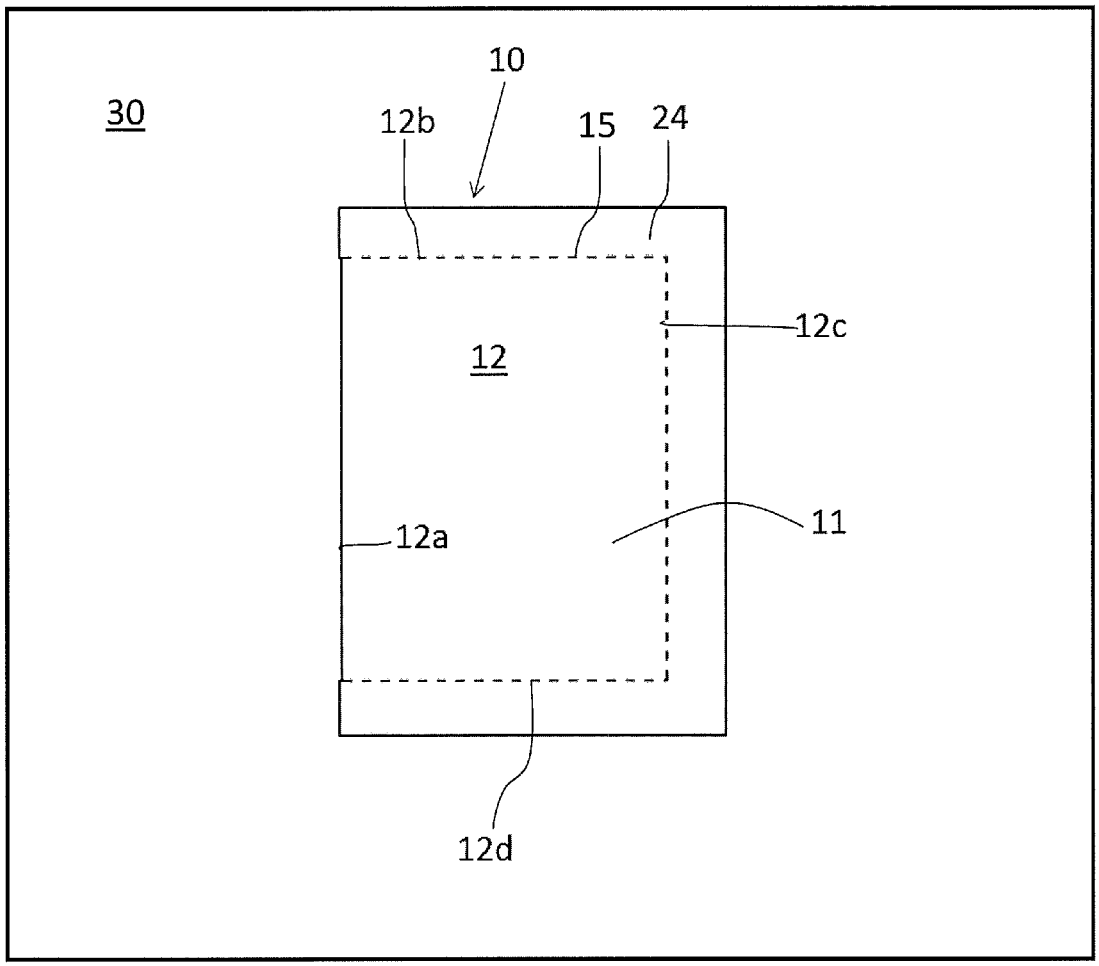
FIG. 2A is a front plan view of the shipping document of FIG. 1 adhered to a shipping container.
Figure 2B:
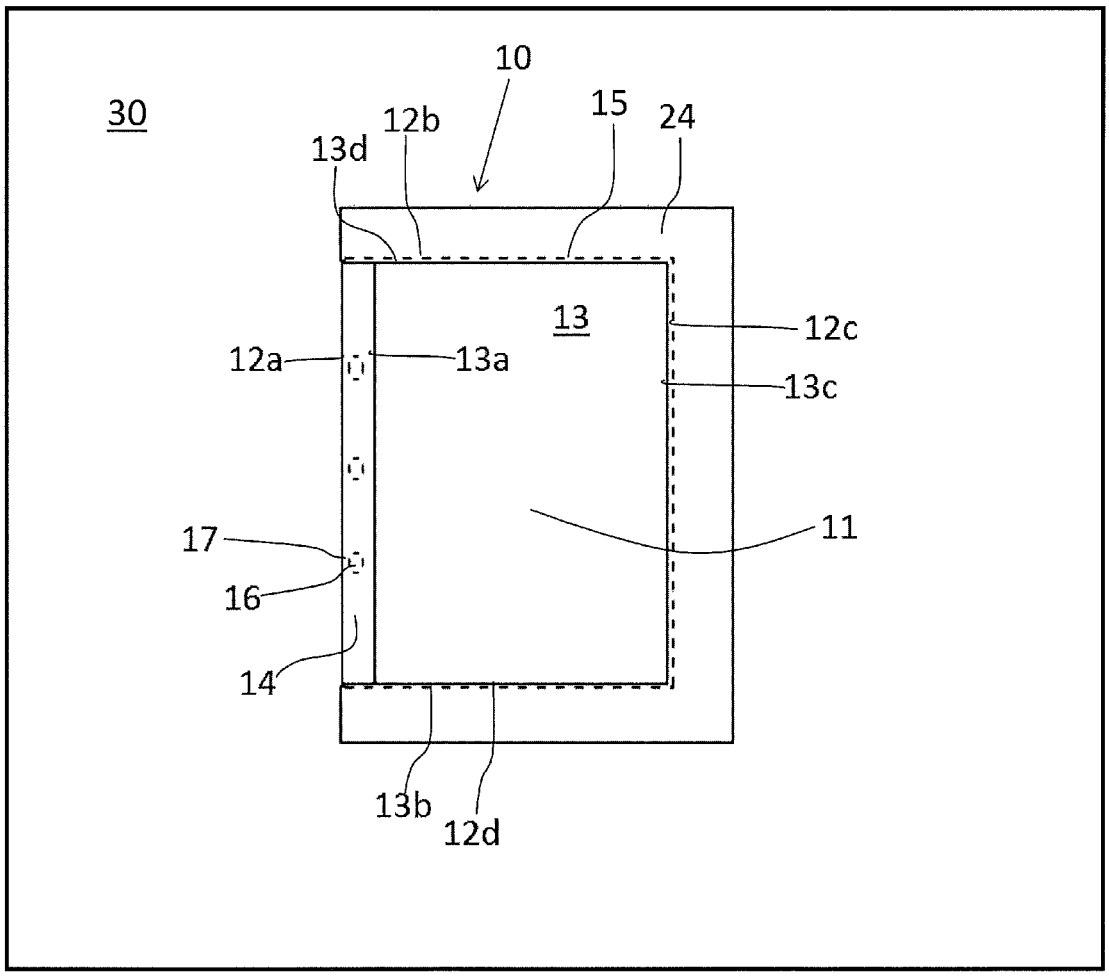
FIG. 2B is a rear plan view of the Shipping document of FIG. 2A.

The printable portions 12, 13 are attached together by a connecting strip 14, which extends at least partially along the connecting edge 12*a* of the first printable portion 12 and a connecting edge 13*a* of the second printable portion 13. The connecting strip 14 is thus disposed between the first and second printable portions 12, 13, preferably integral therewith (i.e. part of the same sheet of paper). The long edges of the connecting strip 14 may be provided with score lines along the connecting edges 12*a*, 13*a* as shown, to facilitate folding along said edges 12*a*, 13*a* when the shipping document 10 is applied to a carton 30, so that the second printable portion 13 can be folded along the respective connecting edges 12*a* or 13*a* and tucked underneath the first printable portion 12, as shown in FIGS. 2A and 2B and discussed in more detail below.

The connecting strip 14 comprises at least one detachable chad 16, preferably three as in the embodiment shown. The detachable chad 16 may be formed by perforating or partially punching a hole through the connecting strip 14, or in such other manner that the chad 16 remains attached to the connecting strip 14 but can be readily detached along the perforation lines 17 by the application of manual pressure. Preferably the detachable chads 16 are generally evenly spaced apart along the connecting strip 14, to provide a stable attachment to the container 30 as described below. The chads 16 may be any shape or size, as long as after detachment of the chads there is sufficient material left in the connecting strip 14 that the first and second printable portions remain attached together.

The shipping document 10 is preferably a normal letter size (8.5"×11") sheet of paper (with respective border strips 24 as described below), but the size of the printable portions 12, 13 may be selected as desired based on the information to be contained in the printable portions 12, 13.

The first printable portion 12 of the shipping document 10 further comprises free edges 12*b*, 12*c* and 12*d*. A border strip 24 extends from at least one of the free edges 12*b*, 12*c* or 12*d*. Preferably each free edge 12*b*, 12*c*, 12*d* is provided with a border strip 24, thus creating a border surrounding the outer periphery of the first printable area 12. The border strips 24 are detachably connected to the first printable portion 12, for example via perforations 15, so that the border strips 24 are attached to the first printable portion 12 but can be readily detached by the application of manual pressure. The size of the second printable portion 13 is selected such that when the second printable portion 13 is folded against the rear face of the first printable portion 12 the border strips 24 extend beyond the free edges 13*b*, 13*c*, 13*d* of the second printable portion, as shown in FIG. 2B, leaving the rear faces of the border strips 24 exposed.

In the embodiment shown the connector strip 14 extends along the entire connecting edges 12*a*, 13*a*, for the most secure attachment between the first and second printable portions 12, 13; and the border strips 24 extend along the entire free edges 12*b*, 12*c*, 12*d* for the most secure attachment to the container 30; however is it possible for the connecting strip 14 and/or the border strips 24 to instead extend partially along the respective edges or to be replaced by tabs or webs (not shown) of the sheet material.

An adhesive is applied to the front faces of the chads 16 and the rear faces of the border strips 24, for affixing the shipping document 10 to the external surface of a shipping container 30 as described below. Any adhesive suitable for adhering the shipping document 10 to the container 30 may be used. In the preferred embodiment pressure sensitive adhesive is applied to the chads 16 and the border strips 24 while the shipping document 10 is in the form of a blank, but after printing. In this embodiment a release layer protects the adhesive from premature adhesion until the shipper is ready to apply the shipping document 10 to the container 30. Alternatively, chemical adhesives, double-sided tape or any other suitable means of adhering the shipping document 10 to the container 30 may be employed.

The appropriate connection strength of the detachable elements (chads 16 and border strips 24) is selected as appropriate for the desired application, based on conditions that are expected to occurring during use of the shipping document. The number and size of the chads 16 are chosen to allow for manual removal of the shipping document 10 at the destination, while ensuring a secure attachment to the shipment container 30 to reduce the likelihood of inadvertent detachment of the shipping document 10 during shipment or delivery.

Figure 3:
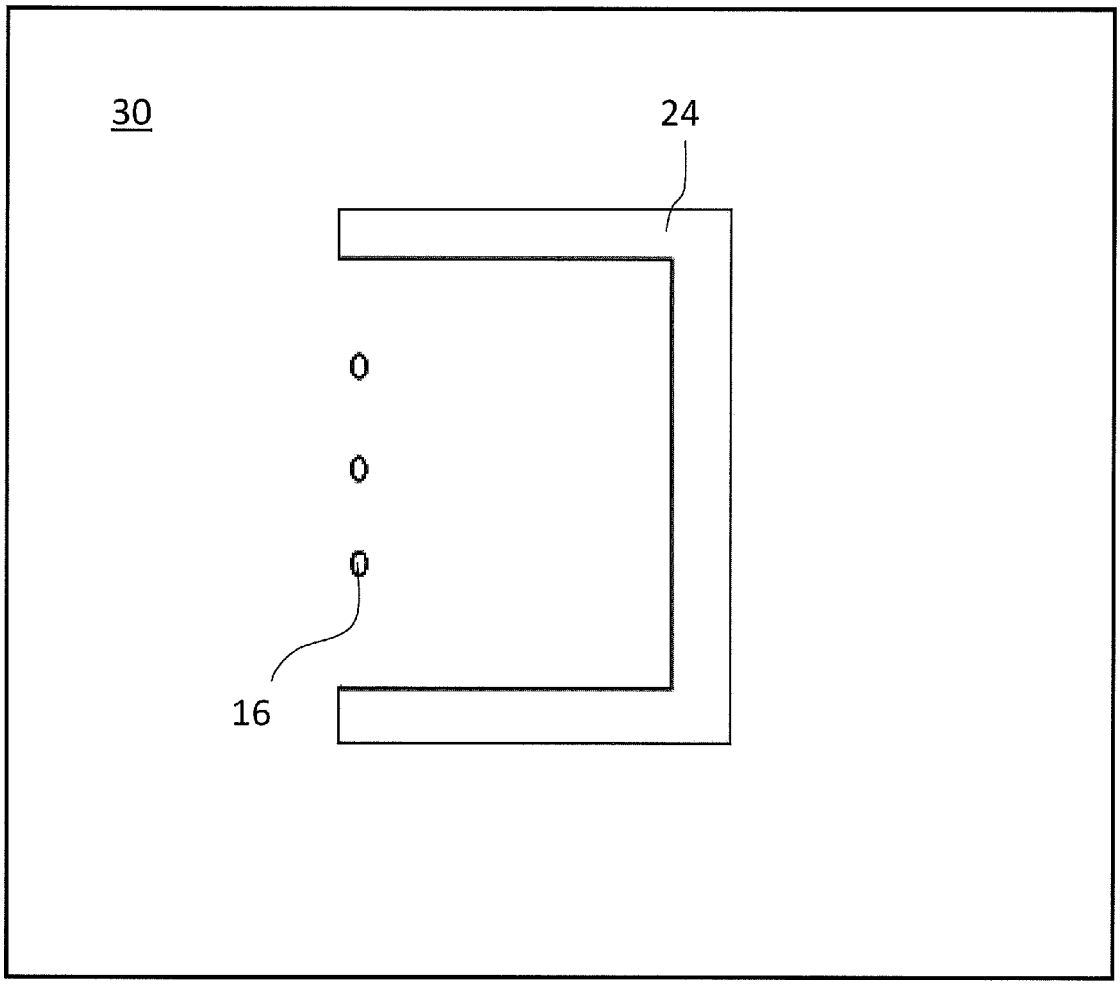
FIG. 3 is a front plan view showing the detachable components of the shipping document of FIG. 2 remaining adhered to the shipping container after removal of the shipping document.
Figure 4:
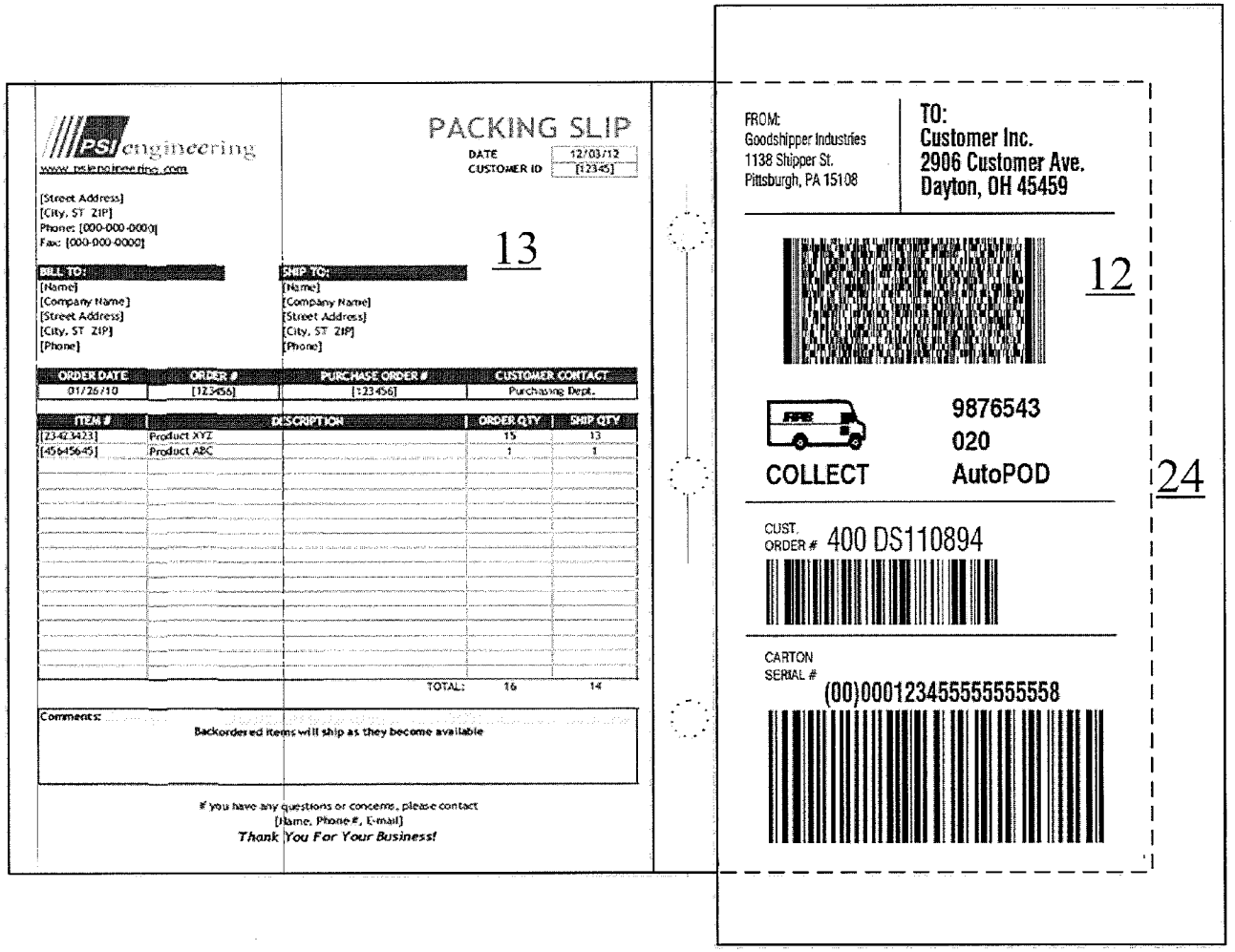
FIG. 4 is a front plan view of the blank of FIG. 1 printed with information and indicia in accordance with the invention.

In the use of the embodiment depicted in FIGS. 1 to 4, the adhesive (if not already pre-applied) is applied to the front faces of the chads 16 and of the rear faces of the border strips 24. The second printable portion 13 together with the connecting strip 14 are folded against the rear surface of the first printable portion 12 along the edge 12*a*, so that the front face of the connecting strip 14 (and thus of the chads 16) now faces toward the rear (i.e. toward the container 30). When folded in this manner, the second printable portion 13 does not contact the adhesive on the rear faces of the border strips 24, which extend beyond the edges 12*b*, 12*c*, 12*d* of the first printable portion 12, but instead is substantially disposed within the area of the rear face of the first printable portion 12. The shipping document 10 is then adhered to the container 30 simply by applying pressure along the edges 12*a*, 12*b*, 12*c* and 12*d* of the first printable portion 12. Once applied to the container 30 the first printable portion 12 remains visible, while the second printable portion 13 is concealed beneath the first printable portion 12 and therefore not visible, as shown in FIG. 2A, until the shipping document 10 is removed from the container 30. It is thus preferable in this embodiment that the shipping label be printed on the front face of the first printable portion 12 and the packing slip be printed on the front face of the second printable portion 13, as shown in FIG. 4. When the second printable portion 13 is folded under the first printable portion 12 and the shipping document 10 is applied to the surface of a shipping container 30 as described above, the only visible part of the shipping document 10 will be the shipping label.

Upon receipt the recipient of the shipping container 30 is able to manually remove the shipping document by grasping same, for example inserting one or two fingers beneath the edge 12*a* between chads 16, and drawing the shipping document 10 away from the container to separate it from the chads 16 and border strips 24 along the perforations 17 and 15, respectively. After removal of the shipping document 10, the now detached chads 16 and border strips 24 are left behind as a waste portion of the shipping document 10 (i.e. they remain attached to the shipping container 30 via the adhesive), as shown in FIG. 3.

Figure 5:
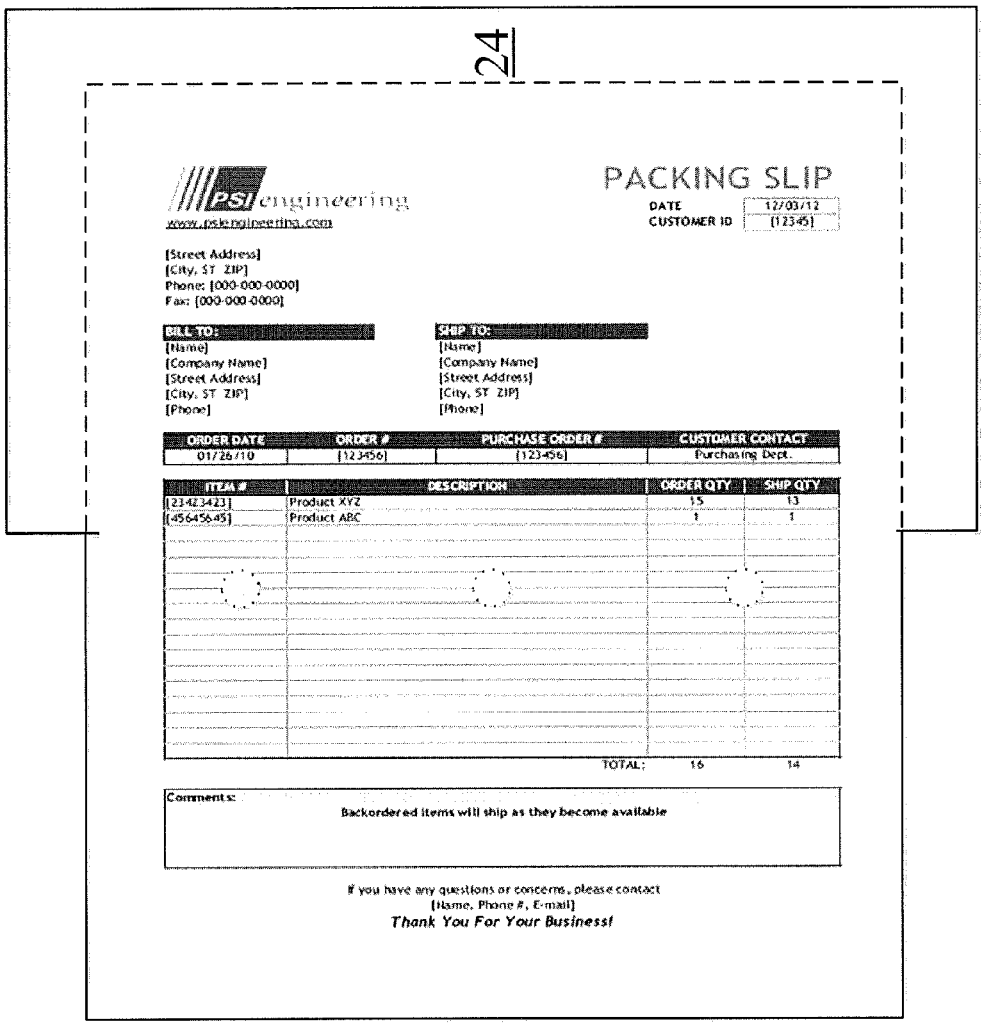
FIG. 5 is a rear plan view of a further embodiment of a printed shipping document in accordance with the invention.

In another embodiment, illustrated in FIG. 5, the packing slip is printed on the entire rear face 11 of the shipping document 10, so that the shipping label and the packing slip are printed on opposite sides of the shipping document 10. When the second printable portion 13 is folded under the first printable portion 12 and the shipping document 10 is applied to the surface of a shipping container 30 as described above, the only visible portion on the surface of the container is the shipping label. However, in this embodiment the area available for packing slip is much larger. The packing slip may be printed in portrait orientation, or in landscape orientation as shown. Another option is to use legal size (8.5"×14") paper and print the shipping label on the first printable portion 12, leaving room for a letter size (8.5" by 11") packing slip in the second printable portion 13 which can be printed in simplex mode (one-sided).

The individual printable areas 12 and 13 can be further subdivided as desired. Since only the front face of the first printable portion 12 is visible when the shipping document 10 is in the folded condition shown in FIG. 2, the front face of the second printable portion 13 and the rear faces of both the first and second printable portions 12, 13 may contain any information and/or indicia not required to be seen during shipping. Perforated lines may be used between portions for easy detachment.

The addition of further printable portions is optional, for example as shown in FIG. 5. In another example, two small packing slips may be displayed side-by-side on the front face or the back face of the second printable portion 13. Alternatively, a packing slip can be imprinted in a larger format on either the entire front face of the second printable portion 13 or the entire back face of the print.

Figure 6:
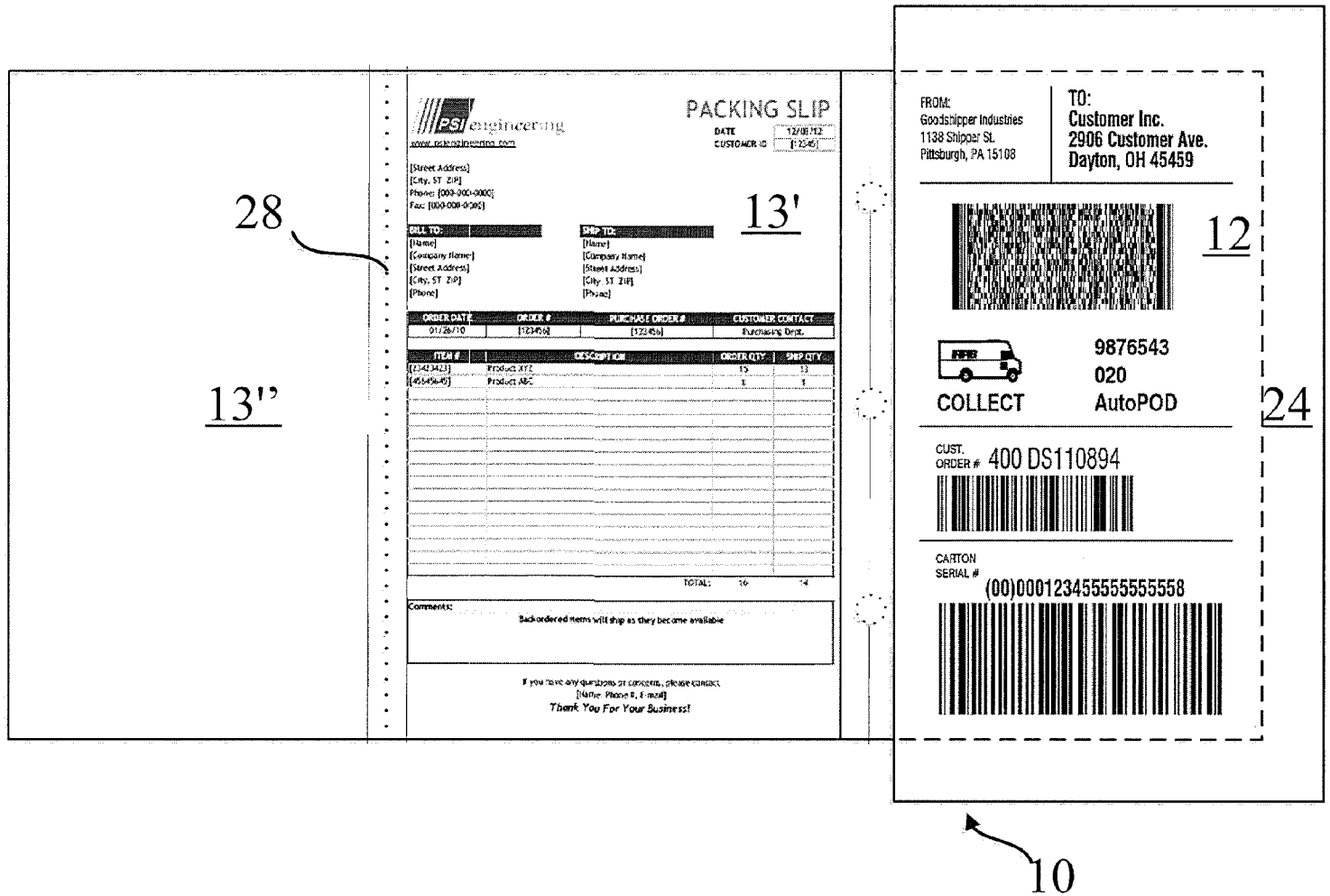
FIG. 6 is a plan view of a further embodiment of a printed shipping document in accordance with the invention.
Figure 7:
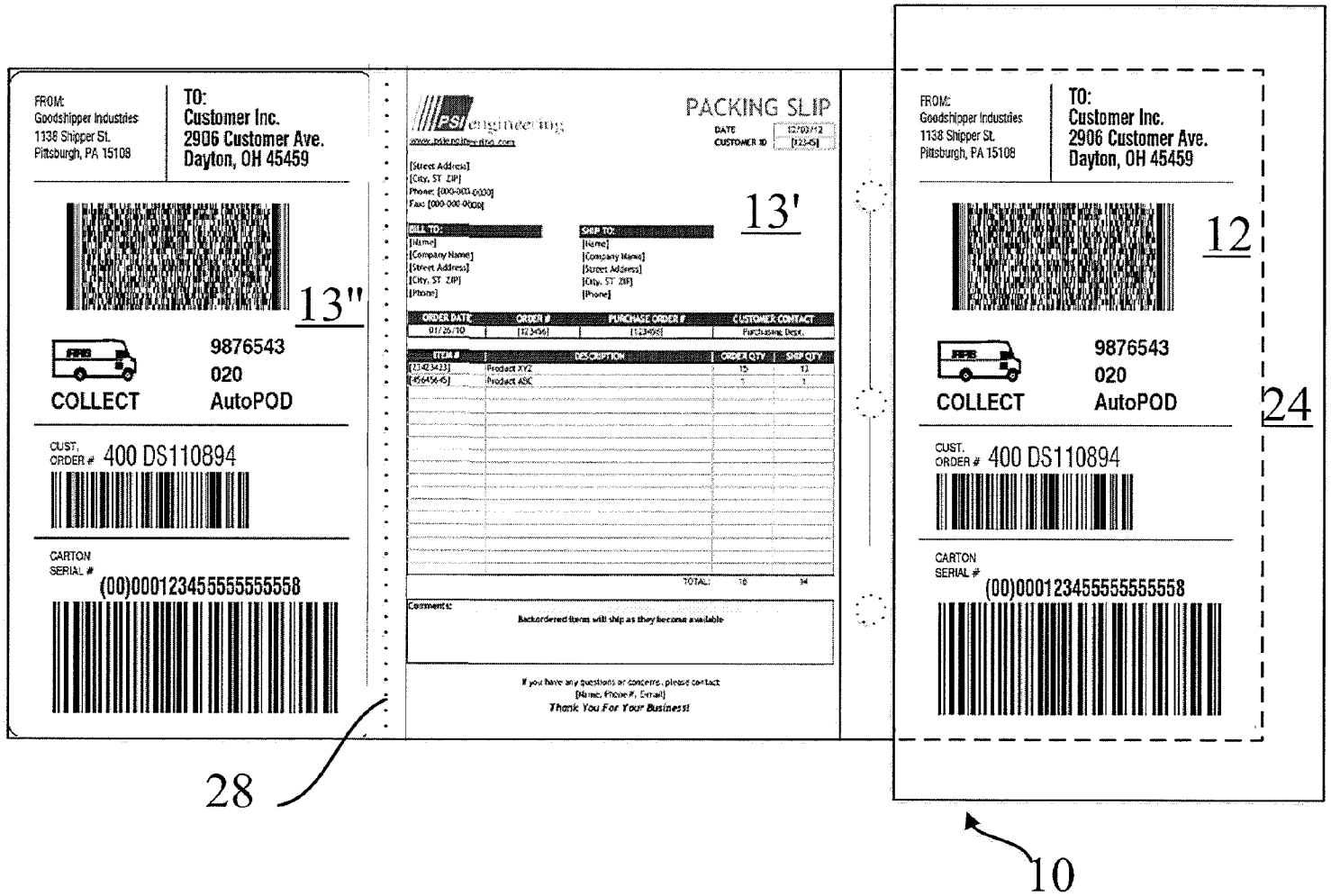
FIG. 7 is a plan view of a further embodiment of a printed shipping document in accordance with the invention, having multiple shipping labels.

In a further embodiment, shown in FIG. 6, the second printable portion 13 can be divided into two sub-portions separable from one another through the use of perforations 28. As shown in FIGS. 6 and 7, the second printable portion 13 can be divided into further portion 13' and 13", which may be separably connected to each other by use of a line of weakening such as perforations 28, or foldable using a score or fold line (not shown) at the dividing point. The printable sub-portions 13', 13" of the second printable portion 13 may each contain information and indicia, and can be folded against one another before folding the second printable portion 13 under the first portion 12. When detached from the container 30 the second packing label (for example, a return shipping label for the use of the recipient, as shown in FIG. 7) in the printed sub-portion 13" can be detached from the packing slip in the printed sub-portion 13' of the second printable portion 13.

Alternatively, the printable sub-portion 13" may be left blank, as shown in FIG. 6, and its rear face affixed to the external surface of the shipping container 30 to strengthen adhesion of the shipping document 10 to the container. In this instance the affixed printable-sub-portion forms an additional tear-away element that is left behind when the shipping document 10 is detached from the shipping container 30.

Figure 9:
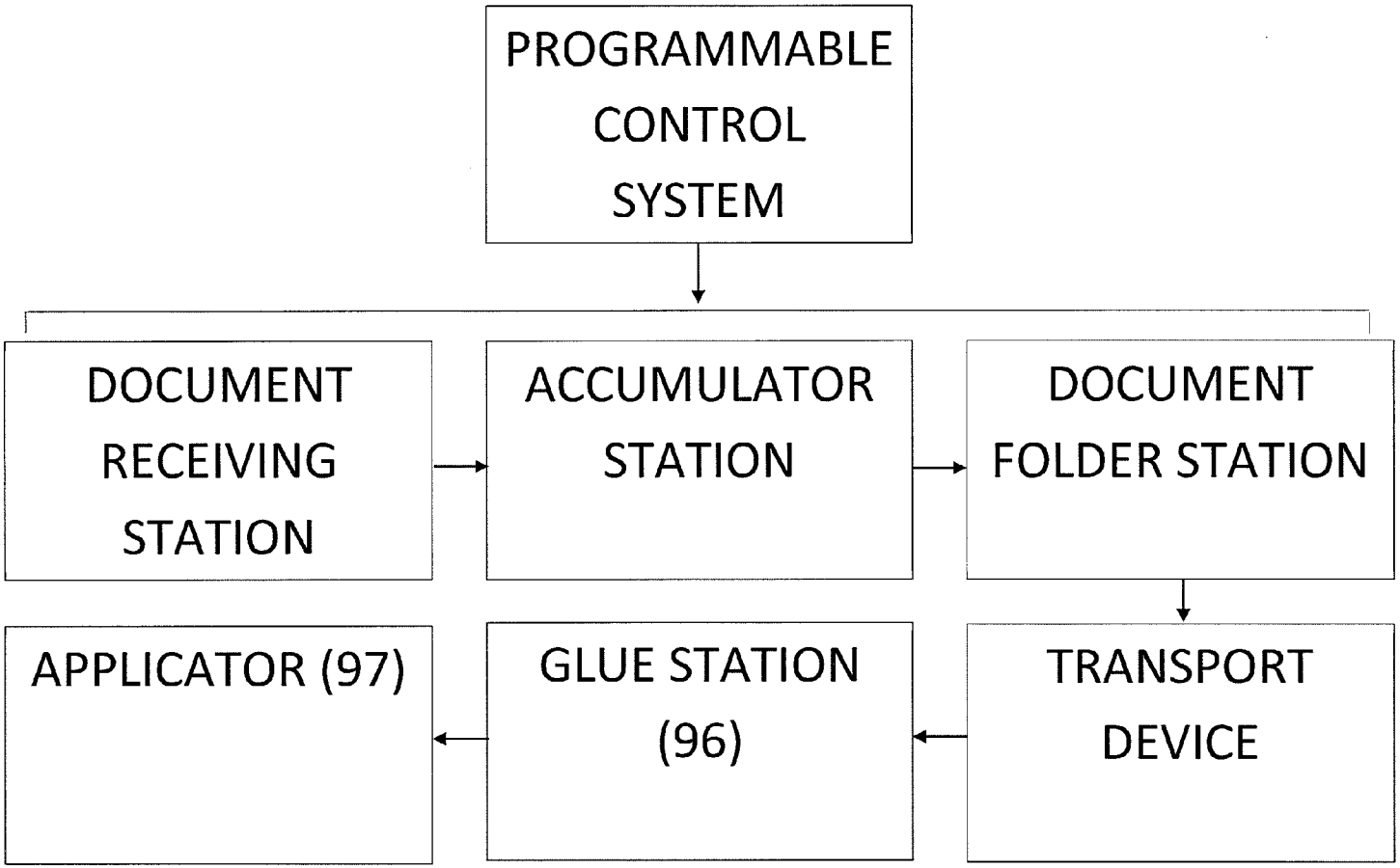
FIG. 9 is a block diagram of an apparatus for creating shipping documents in accordance with the invention.

An adjustable, programmable high-speed apparatus with central control of the apparatus and shipping document formation process is preferably employed to make the shipping documents. The apparatus, illustrated in FIG. 9, receives and accumulates (single or multiple) documents into sets; then folds, orients, separates, delivers and/or applies shipping documents 10 to shipping containers 30.

In particular, the apparatus preferably comprises an adjustable high-speed document receiving station which accepts various sized outputs from common printers and feeds them to an adjustable accumulator station which uses various types of sensors, optical marks and/or software to control the number of documents accumulated and forming multiple sets, of single or a variable number of documents, and initiates movement of the documents to subsequent stations. The adjustable document folder station provides various optional folds, to a single or variable number of documents, followed by an optional further fold to create a smaller size. An adjustable transport device presents the document to other stations in several orientations, directions and different rotations in accordance with the apparatus programming. Another adjustable and integrated device, the glue station 96, applies inline patterned adhesive or tape to the appropriate portions of the processed document while being transported. The document may be treated with pressure seal glue patterns for self-sealing, or may be designed for self-sealing as it is being applied to the shipping container. An additional adjustable device, the applicator 97, applies the self-adhering document to the surface of a shipping container 30, such as a carton, envelope, container or item. An adjustable programmable control system controls the various print, accumulator, folding, separation, transporting and application stations for related document preparation and attachment.

Figure 10:
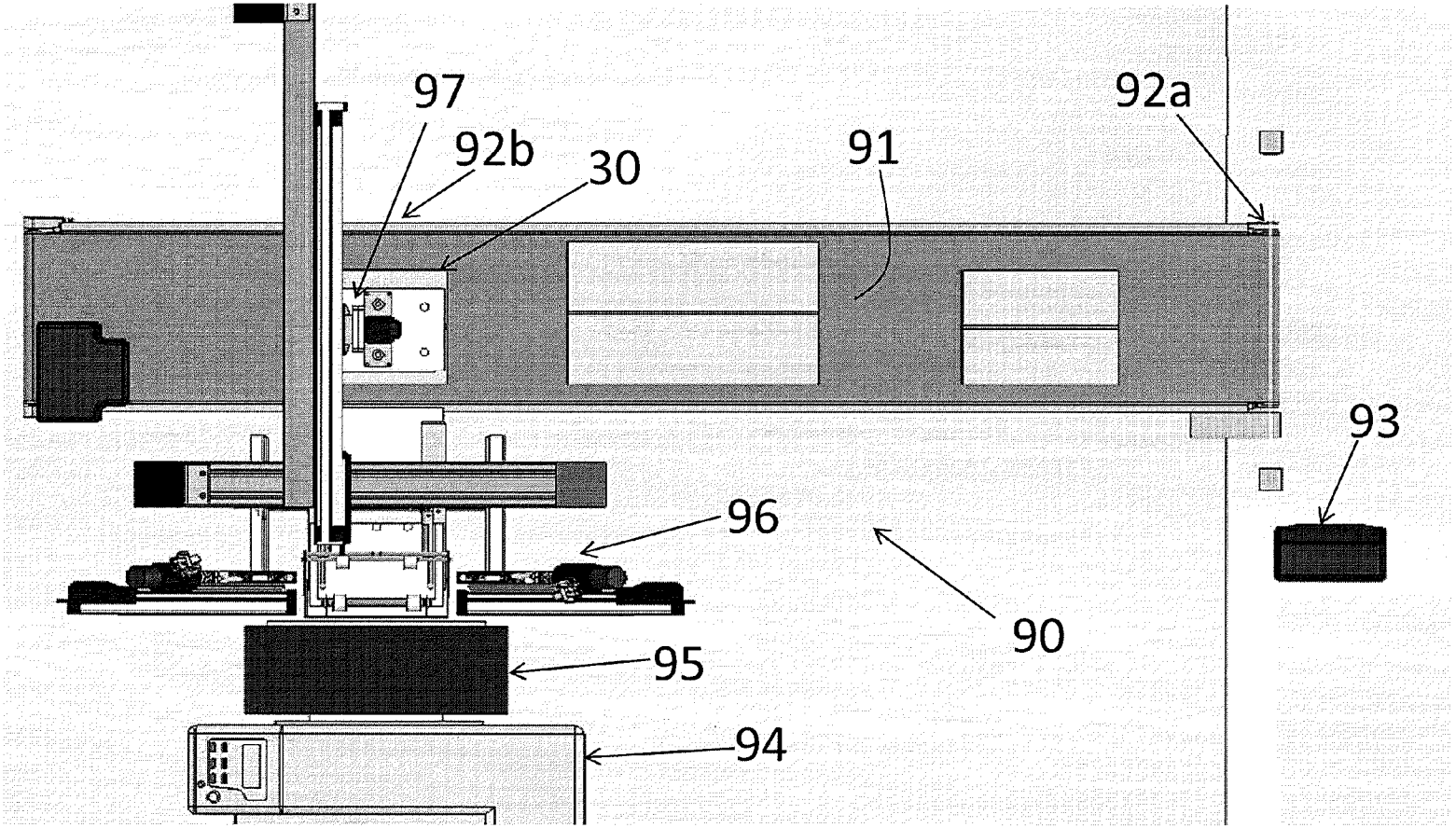
FIG. 10 is a top plan view of one embodiment of an apparatus for creating shipping documents in accordance with the invention.

The apparatus 90 illustrated in FIG. 10 is preferably employed for smaller scale projects. With this apparatus, a shipping container 30 (for example, cartons as depicted) is transported via a conveyor 91 and scanned at a scan point 92*a*. The control software 93 will send a print file to the printer 94. The printer 94 prints the document 10 (not shown in FIG. 10), which is subsequently placed in the folder 95. The document 10 is folded in half and glue is applied at the glue station 96 through a combination of movement of glue heads and travel of documents along the conveyor. The document 10 is flipped to allow glue to be applied to the bottom of the document (or alternatively glue may be applied from the opposite side of the conveyor without flipping the document), picked up (for example by a vacuum-actuated pick-up arm), oriented and/or rotated as necessary, and is then fed to the applicator 97 where, once the respective shipping container 30 reaches a second scan point 92*b*, it is applied to an external surface of the shipping container 30. With this apparatus, the throughput is dependent on the start-up cycle of the printer and can generally provide a throughput of up to 8 shipping containers per minute.

Figure 8:
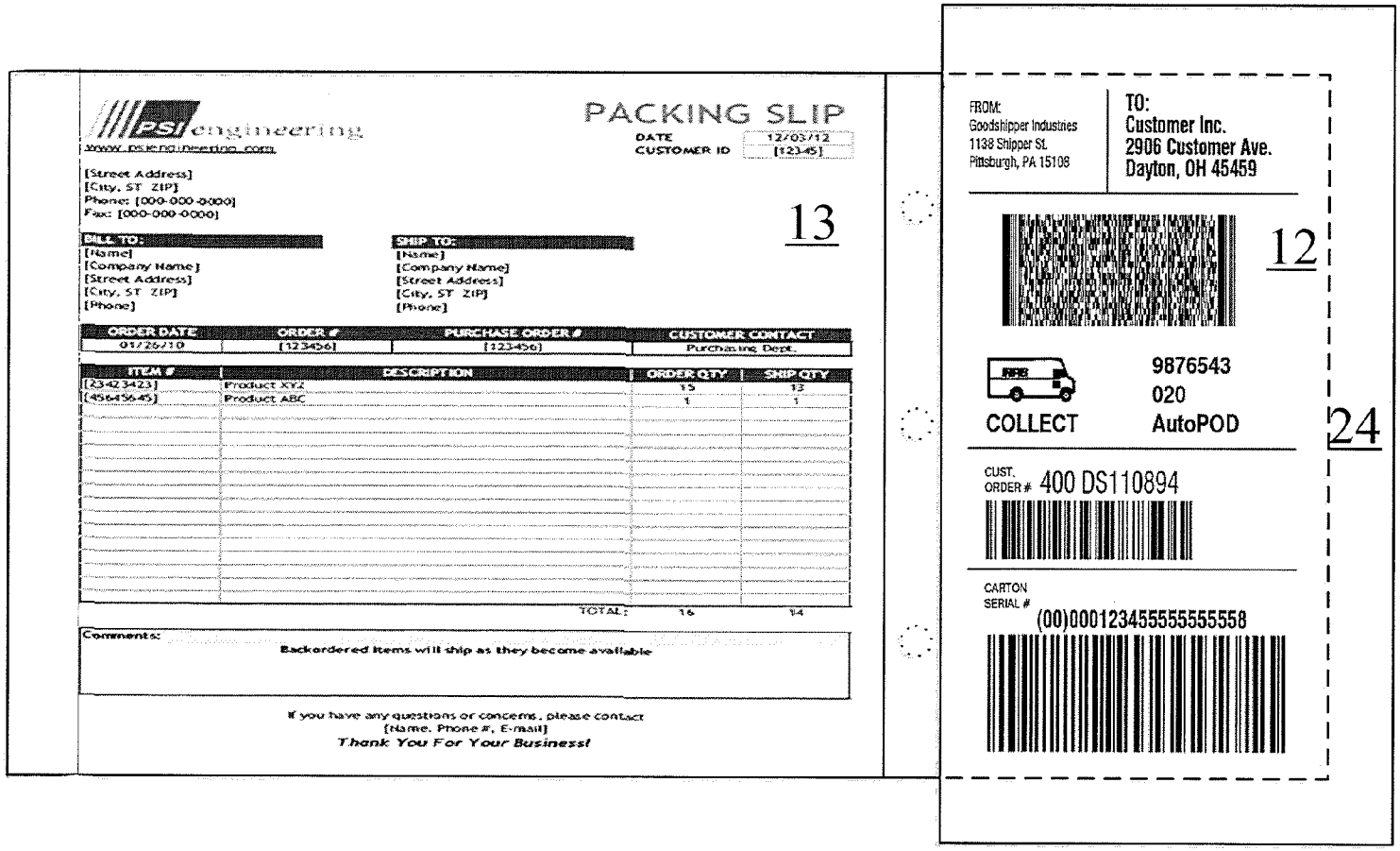
FIG. 8 is a plan view of a further embodiment of a printed shipping document in accordance with the invention.
Figure 11:
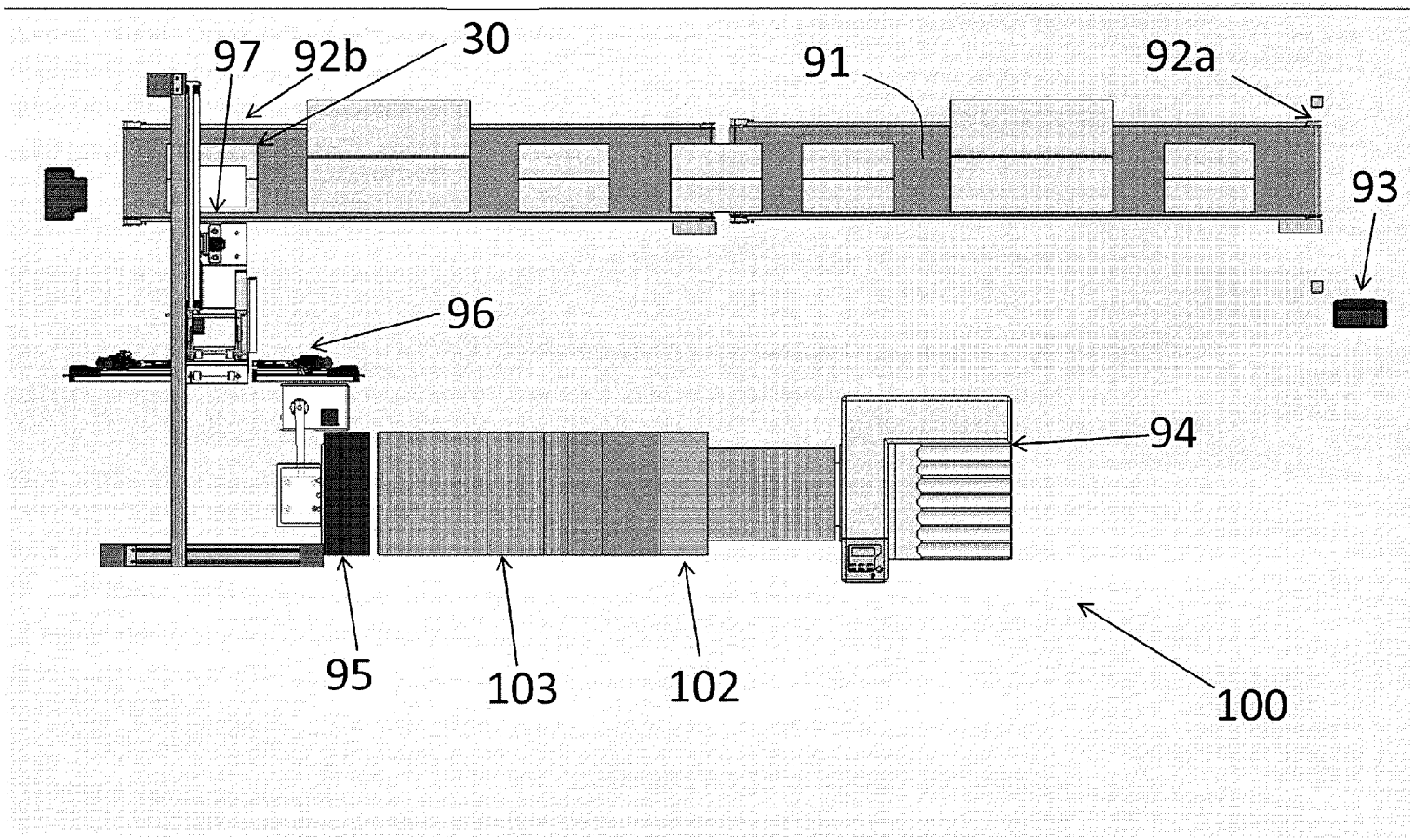
FIG. 11 is a top plan view of a further embodiment of an apparatus for creating shipping documents in accordance with the invention.

For larger scale systems requiring more demanding throughput, the apparatus 100 illustrated in FIG. 11 may be employed. This system generally allows throughput rates of about 20 shipping containers per minute and may be streamlined to provide higher throughput of up to 25 or 30 per minute. The operation of this apparatus and process is very similar to that described above in respect of FIG. 8, however in this system shipping containers 30 are scanned at the start of a cycle, thereby initiating the printing and preparatory process for the shipping documents 10 (not shown in FIG. 11). Once the shipping documents 10 have been printed with the relevant information, they are mechanically held in a document-buffering zone 102 followed by a document-staging zone 103. In this embodiment throughput is not dependent on the start-up cycle of the printer 94 because in this case multiple shipping documents 10 are continuously printed without having the printer 94 shut down in between.

Various embodiments of the present invention having been thus described in detail by way of example, it will be apparent to those skilled in the art that variations and modifications may be made without departing from the invention. The invention includes all such variations and modifications as fall within the scope of the appended claims.

I claim:

1. A shipping document comprising:

a printable sheet having a front face for containing printed matter and a rear face, comprising a first printable portion and a second printable portion attached together by a connecting strip comprising at least one detachable chad, the connecting strip extending at least partially along a connecting edge of the first printable portion, and at least one detachable border strip removably attached to at least one free edge of the first printable portion, such that when the second printable portion is folded against the rear face of the first printable portion the border strip extends beyond the second printable portion, whereby adhesive is applied to the front face of the removable chad and the rear face of the border strip, such that the shipping document is configured to be secured to a surface by the adhesive with the second printable portion and the border strip folded against the first printable portion, and subsequently removed from the surface by detaching the border strip and the chad from the sheet while the first and second printable portions remain attached by the connecting strip.

2. The document of claim 1 wherein border strips are attached to a plurality of free edges of the first printable portion.

3. The document of claim 2 including a plurality of connecting edges, wherein the connector strip extends along the entire connecting edges, wherein the border strips extend along the entire free edges.

4. The document of claim 1 wherein pressure sensitive adhesive is applied to the at least one chad and the border strip.

5. The document of claim 1 wherein the printable sheet is formed from a sheet of paper.

6. The document of claim 1 wherein the second printable portion comprises at least two sub-portions connected together.

7. The document of claim 6 wherein the sub-portions are detachably connected.

8. The document of claim 6 wherein the at least two sub-portions can be folded against one another, such that when the second printable portion is folded against the rear face of the first printable portion the at least one border strip extends beyond the folded sub-portions.

9. The document of claim 8 wherein when an adhesive is applied to the rear face of one of the at least two sub-portions, the document can be secured to the surface by the adhesive, and subsequently removed from the surface by detaching the adhered sub-portion while at least one remaining sub-portion of the second printable portion remains attached to the first printable portion by the connecting strip.

10. The document of claim 1 wherein the front face of the first printable portion comprises shipping information.

11. The document of claim 1 wherein the front face of the second printable portion comprises container contents information.

12. The document of claim 1 including a plurality of detachable chads evenly spaced apart along the connecting strip, wherein the chads are configured so that after detachment of the chads there is sufficient material left in the connecting strip such that the first and second printable portions remain attached together.

13. A method of applying a shipping document to a surface, the shipping document having a front face for containing printed matter and a rear face and comprising a first printable portion attached to a second printable portion by a connecting strip comprising at least one detachable chad, the connecting strip extending at least partially along a connecting edge of the first printable portion, and at least one detachable border strip removably attached to at least one free edge of the first printable portion such that when the second printable portion is folded against the first printable portion the border strip extends beyond the second printable portion, comprising the steps of:

a. folding the second printable portion against the rear face of the first printable portion, and b. adhering the chad and the border strip to the surface, whereby the shipping document can be removed from the surface by detaching the border strip and the chad from the sheet, while the first and second printable portions remain attached along the connecting strip.

14. The method of claim 13, wherein the second printable portion comprises at least two sub-portions and further comprising the step, before step a., of folding the at least two sub-portions against one another such that when the second printable portion is folded against the rear face of the first printable portion the border strip extends beyond the folded at least two sub-portions of the second printable portion.

15. The method of claim 14 wherein the sub-portions are detachably connected.

16. The method of claim 13 comprising the step, before step a., of printing information on the document using a conventional printer.

17. The method of claim 13 comprising the step, before step a., of printing information on the front face of the first printable portion.

18. The method of claim 13 comprising, before step a., the step of printing information on the front face of the second printable portion.

19. The method of claim 13, wherein a rear face of the shipping document comprises a printable surface for containing printed matter, including the further step, before step a., of printing information on the rear face of the first printable portion or the second printable portion, or both.

20. The method of claim 13 wherein border strips are attached to a plurality of free edges of the first printable portion, and step b. includes the step of adhering all border strips to the surface.

21. The method of claim 13 comprising, before step a., the step of applying pressure sensitive adhesive to the at least one chad and the border strip.

22. The method of claim 20 wherein the adhesive is applied to a front face of the at least one chad and a rear face of the border strip.

23. The method of claim 13 wherein the printable sheet is formed from a sheet of paper.

24. The method of claim 13 wherein the second printable portion together with the connecting strip are folded against a rear surface of the first printable portion along the edge such that a front face of the connecting strip faces toward the rear direction.

* * * * *